US005097750A

United States Patent [19]

Oldham, deceased et al.

[11] Patent Number: 5,097,750

[45] Date of Patent: Mar. 24, 1992

[54] WASTE MANAGEMENT DISPOSAL SYSTEM

[75] Inventors: John V. Oldham, deceased, late of Ridgefield, by Vincent Oldham, executor; Chinsoo Park, Rutherford, both of N.J.; William M. Marston, Conowingo, Md.; John E. Sheaffer, Havre de Grace, Md.; Eric A. Deitrich, Woodbine, Md.; Neil E. Campbell, Hasbrouck Heights, N.J.; Albert P. Ruggieri, Flourtown, Pa.

[73] Assignee: Lab Products, Inc., Maywood, N.J.

[21] Appl. No.: 297,220

[22] Filed: Jan. 13, 1989

[51] Int. Cl.[5] ..... B65F 1/14

[52] U.S. Cl. ..... 454/63; 55/385.4; 55/467; 220/404; 220/908; 454/344

[58] Field of Search ..... 55/315, 385.4, 467; 98/115.1, 115.3; 220/1 T, 404; 312/211

[56] References Cited

U.S. PATENT DOCUMENTS

| | | | |
|---|---|---|---|
| 169,490 | 11/1875 | Smith | 98/115.1 X |
| 816,989 | 4/1906 | Moler et al. | 220/404 X |
| 1,218,632 | 3/1917 | Derry | 220/404 X |
| 3,877,902 | 4/1975 | Eriksson et al. | 55/467 X |

FOREIGN PATENT DOCUMENTS

| | | | |
|---|---|---|---|
| 1053195 | 2/1954 | France | 98/115.1 |
| 322817 | 10/1935 | Italy | 98/115.1 |
| 546240 | 7/1942 | United Kingdom | 98/115.1 |

*Primary Examiner*—Harold Joyce
*Attorney, Agent, or Firm*—Blum Kaplan

[57] ABSTRACT

A waste management disposal system which disposes of both solid and aerosol waste includes a housing divided into a solid waste containment area and a negative pressure plenum for drawing aerosol waste away from the solid waste containment area. A funnel is provided for guiding solid waste into the waste containment area and the negative pressure plenum draws the aerosol waste in a path orthogonal to the funnel. A filter is provided for filtering the aerosol contaminants from the air upon which it is being transported.

27 Claims, 3 Drawing Sheets

WASTE MANAGEMENT DISPOSAL SYSTEM

BACKGROUND OF THE INVENTION

This invention is directed to a waste management disposal system for the disposal of contaminated animal waste and, in particular, to a portable disposal system which disposes both solid and aerosol waste.

Systems for disposing contaminated waste are known in the art. Conventional systems consist of a fixed station or room to which the contaminated materials are transported. Horizontal air flow is used to draw the aerosol contaminates into the filter unit as the solid waste is dumped in a bin below the air flow. A rear wall contains a prefilter to filter out the aerosol contaminants prior to exhausting the air.

These systems are less than satisfactory. In operation often much of the bedding intended to drop down into the receptacle is drawn into the prefilters rendering the system useless. Additionally, due to the stationary nature of such systems, the contaminated particles must be transported to the disposal site thus increasing exposure to contamination. Accordingly, a portable waste disposal management system providing vertical air flow is desired.

SUMMARY OF THE INVENTION

Generally speaking, in accordance with the instant invention, a waste disposal management system is provided for disposing of both contaminated aerosol and solid waste. A housing supports at least one disposable bag for containing solid waste which is dumped within the housing. A funnel is disposed within the housing to guide solid waste into the bag while limiting back flow of solid waste. A filter is provided within the housing orthogonal to the top of the funnel. A blower provides negative pressure causing air to travel through the housing across the funnel through the filter removing the aerosol contaminants from the housing and removing the contaminants from the traveling air prior to ejecting the air without the housing.

In an exemplary embodiment clasps are provided within the housing for securing the bag within the housing. The funnel is pivotably mounted within the housing to allow removal of the funnel from the bag.

Accordingly, it is an object of the instant invention to provide an improved waste management disposal system.

A further object of the instant invention is to provide a waste management disposal system which lengthens the operating time of the filter.

Yet another object of the instant invention is to provide a waste management disposal system that is portable and easy to handle.

Still other objects and advantages of the invention will in part be obvious and will be apparent from the specification.

The invention accordingly comprises the features of construction, combination of elements, and arrangement of parts which will be exemplified in the construction hereinafter set forth and the scope of the invention will be indicated in the claims.

BRIEF DESCRIPTION OF THE DRAWINGS

For a better understanding of the invention, reference is had to the following description taken in connection with the accompanying drawings, in which.

DETAILED DESCRIPTION OF THE PREFERRED EMBODIMENTS

Figure 1:
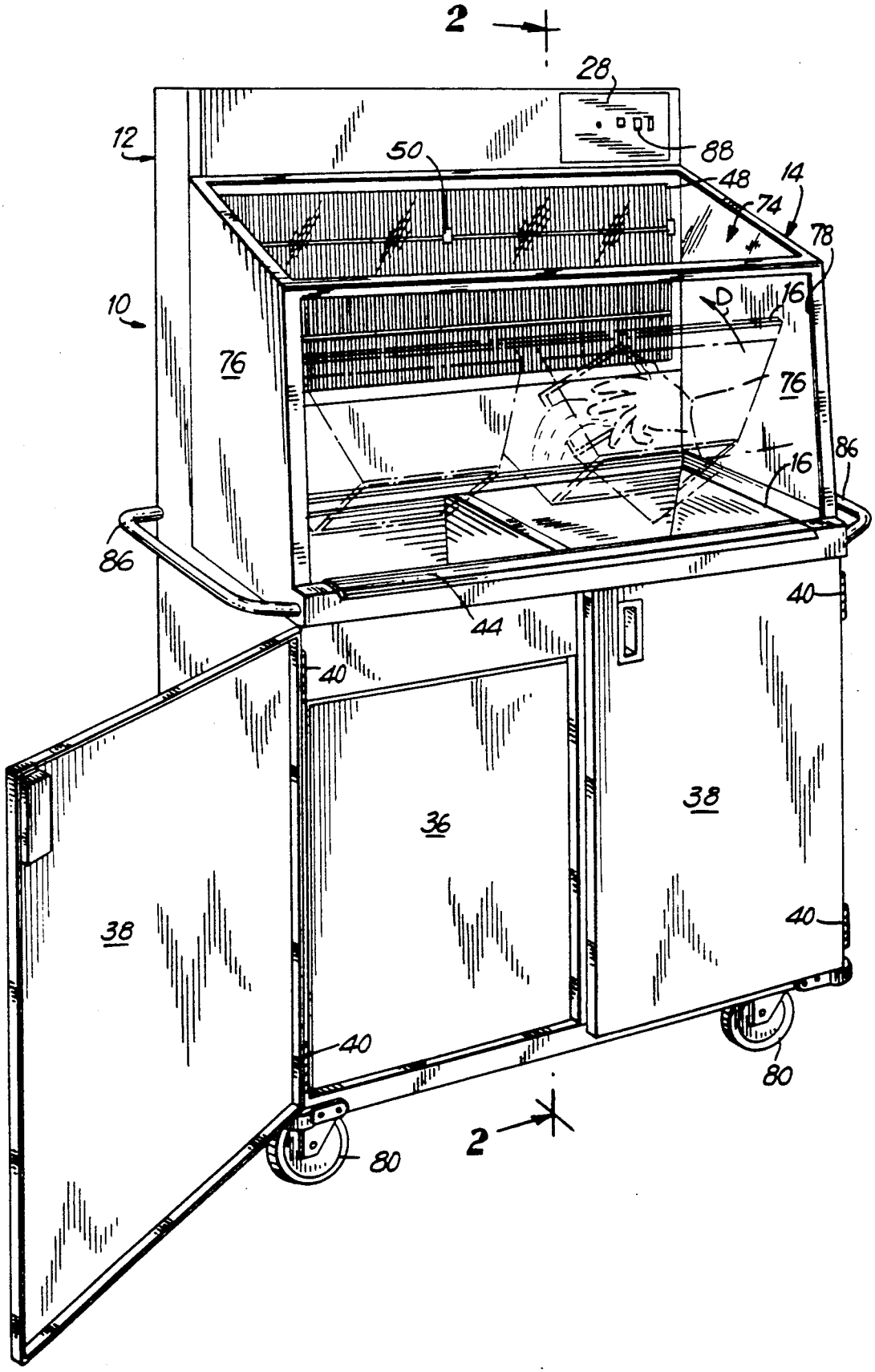
FIG. 1 is a perspective view of a waste management disposal system in accordance with the invention showing movement of the funnel in phantom.
Figure 2:
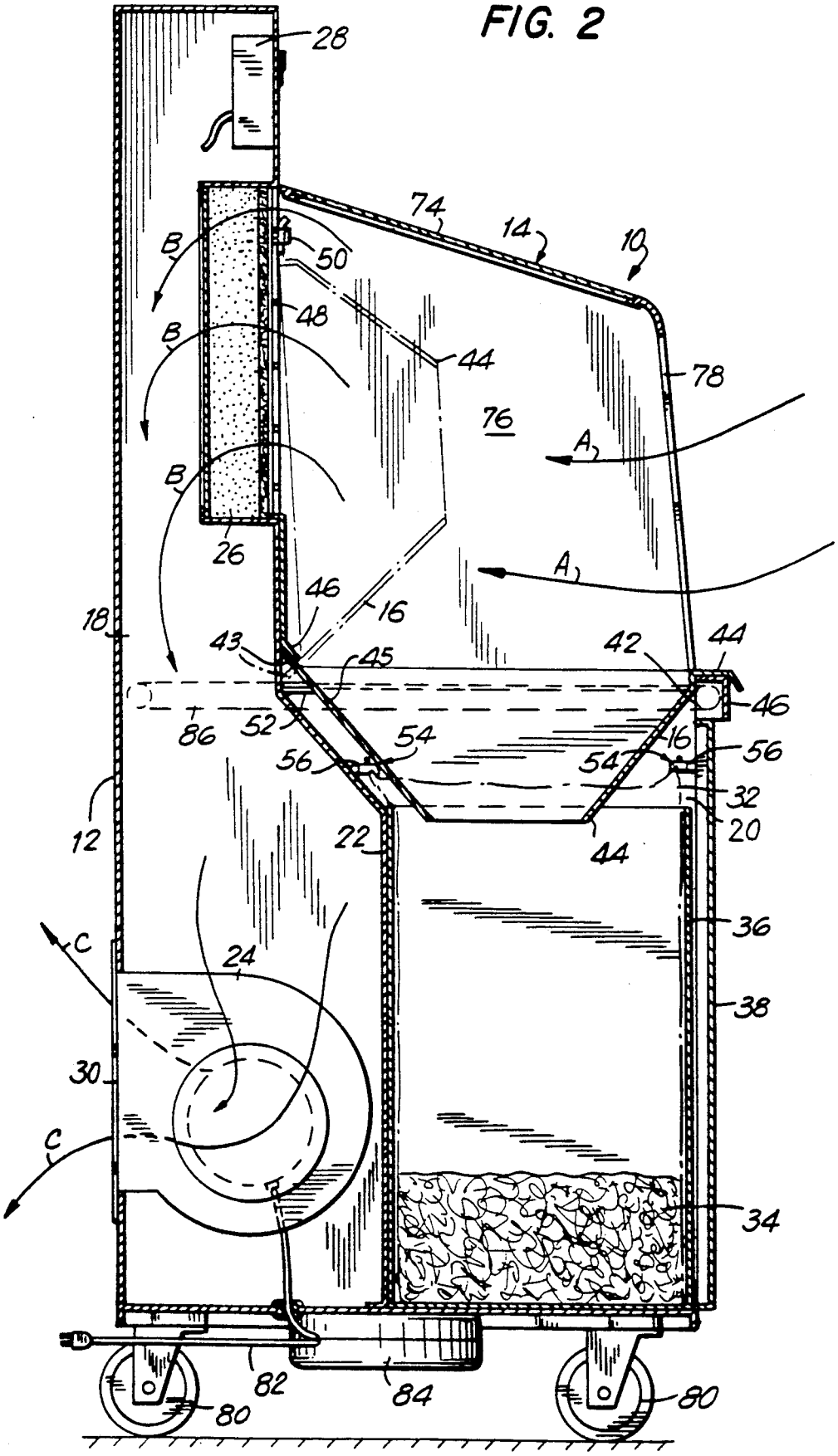
FIG. 2 is a sectional view taken along line 2—2 of FIG. 1.

Reference is made to FIGS. 1 and 2 in which a waste management system, generally indicated at 10, constructed in accordance with a preferred embodiment is depicted. Waste management system 10 includes a housing 12, a hood portion 14 supported on housing 12 and a funnel 16 supported within housing 12.

Housing 12 includes a negative pressure plenum 18 and a solid waste storage area 20 separated from negative plenum 18 by a plenum wall 22 of negative pressure plenum 18. A blower 24 positioned within plenum 18 forces air from negative pressure plenum 18 without housing 12 to provide the negative pressure within negative pressure plenum 18. A filter 26 is supported within negative pressure plenum 18 and provides an interface with the room air, drawing the air carrying the aerosol contaminants through plenum 18 due to the negative pressure of plenum 18. A control box 28 containing the power switch and indication lights is supported on housing 10 partially within negative pressure plenum 18.

In an exemplary embodiment filter 26 includes a three filter layer including a HEPA filter, a pleated pre-filter and a polyester filter which effectively removes 99.99% of aerosol contaminants to a size of 0.3 microns. Additionally, a second HEPA filter 30 is provided at the exhaust of blower 24. Air passes through negative pressure plenum 18 at one hundred cubic feet per minute.

A bag 32 is provided in solid waste storage area 20 for receiving solid waste 34 deposited within waste management system 10. To provide secondary retainment of solid waste 34 and additional rigidity to bag 32, a box 36 for containing bag 32 is also provided within solid waste storage area 20. Front opening doors 38 supported on housing 12 by hinges 40 are provided to allow removable of box 36 and bag 32 when full.

During operation, solid waste 34 is deposited within bag 32. Aerosol contaminants rise above bag 32. Blower 24 causes a negative pressure within plenum 18 on one side of filter 26 causing the room air to travel across bag 32 in the direction of arrows A orthogonal to bag 32. The room air then passes through filter 26 carrying the airborne aerosol contaminants with it so that filter 26 collects the aerosol contaminants as the room air travels in the direction of arrows B through filter 26. Filter 26 is placed high enough above bag 32 so that gravity prevents solid waste from floating into the air path of filter 26. Blower 24 then forces the air contained within plenum 18 through filter 30 in the direction of arrows C releasing the filtered air back into the room. Additionally, by drawing the air in a path orthogonal to bag 32, solid waste 34 is not drawn out of bag 32 by blower 24.

Funnel 16 is formed as a pair of truncated tetrahedrons which rest within an opening 42 of housing 12. The top of funnel 16 is larger than opening 42 so that funnel 16 remains in place within opening 42 by resting against the inner edges of opening 42 due to the weight of funnel 16. For additional support a first tab 44 which extends on top of a front surface 46 of housing 12 is provided. Side tabs (not shown) extend over each side of waste storage area 20 in a manner similar to tab 44. The bottom edge 44 of the truncated tetrahedron extends within bag 32 to guide solid waste 34 within bag 42. In an exemplary embodiment each tetrahedron of funnel 16 extends into a respective bag 32. The tetrahedron shape also acts as a baffle to prevent loose solid waste from rising back through funnel 16 and either escape from waste management system 10 or get caught in filter 26, thereby prematurely clogging the filter.

A flange 43 extends from a rear side 45 of funnel 16 and extends beyond the remaining sides of funnel 16. A back splash plate 46 mounted on housing 12 extends to overlap flange 43. Back splash plate 46 aids in further guiding any loose solid waste 34 through funnel 16 into bag 32. A grill 48 is mounted within housing 12 in front of filter 26. A clip 50 is integrally formed on grill 48.

As shown in phantom, to facilitate the removal of bag 32 from solid waste storage area 20, funnel 16 may be rotated in a direction of arrow D (FIG. 1) removing funnel 16 from bag 32. To free the hands of the system operator, funnel 16 may be fastened to housing 12 by clip 50 so that the operator may utilize both hands to remove bag 32 from solid waste storage area 20. In this position flange 43 rests against a projection 52 of housing 12 which supports the weight of funnel 16 in this position. To prevent escape of contaminants during the removal of bag 32, blower 24 continuously operates and contaminated aerosols pass through funnel 16 in the direction of arrow A to reach filter 26. Accordingly, the waste management disposal system continuously protects the operator from contamination.

In the upright position shown in phantom, flange 43 clears back splash plate 46. Accordingly, funnel 16 may be easily removed from waste management system 10 for cleaning. During this operation, the blowers also continuously operate to further prevent any aerosol contaminants from escaping waste management system 10.

Figure 3:
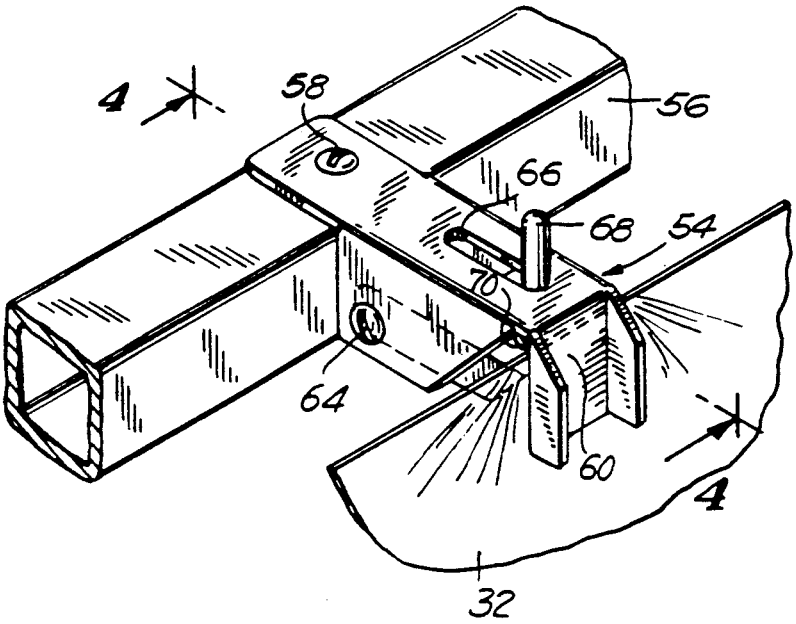
FIG. 3 is a perspective view of a clasp for supporting a waste disposal bag in accordance with the invention.
Figure 4:
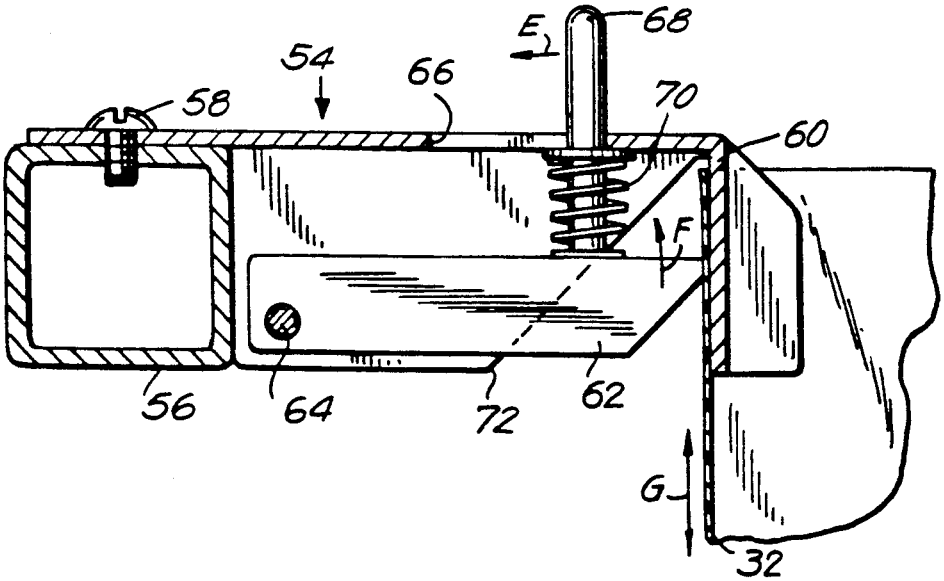
FIG. 4 is a sectional view along line 4—4 of FIG. 1.

Reference is now also made to FIGS. 3 and 4 in which clasps, generally indicated at 54, for maintaining bag 32 in position are depicted. Clasps 54 are mounted on support rods 56 by a screw 58. Support rods 56 are mounted within housing 12 at an intermediate height so as to be above bottom 44 of funnel 16 but not to come in contact with funnel 16. Each clasp 54 includes a front surface 60 and a pivotable retaining arm 62 which in a closed position abuts front surface 60 to maintain bag 32 therebetween. Retaining arm 62 is pivotably mounted about a pin 64 within clasp 54. A button 68 extends from retaining arm 62 through a slot 66 formed in clasp 54 to actuate retaining arm 62 between an open and closed position. Movement of button 68 in the direction of arrow E causes retaining arm 62 to pivot in the direction of arrow F providing an opening between retaining arm 62 and front surface 60 releasing bag 32 from clasp 54. A spring 70 positioned about button 68 biases retaining arm 62 in the closed position. Clasp 56 contains an opening 72 to allow access of bag 32 to clasp 54. To place bag 32 within bag 54, button 68 is pushed in the direction of arrow E and bag 32 is inserted in the upward direction of arrows G.

Hood 14 is mounted on housing 12 above solid waste storage area 20 and provides an enclosure for further containing contaminated aerosol and loose solid waste within waste management system 10. Hood 14 is formed with a top 74 supported by side 76. A front opening 78 is provided within hood 14 to allow access to funnel 16 for disposing waste. Top 74 is made of a transparent material, such as glass or the like to allow the user to observe his actions during disposing of waste. Top 74 is downwardly sloped from housing 12 towards opening 78 to facilitate the viewing through top 74 as well as prevent the system user from hitting their head during use. Additionally, the corners of hood 14 are rounded to prevent damage to the user's shoulders.

So that waste management system 10 is portable, housing 10 is mounted on wheels 80. Electricity is supplied to blower 24 by a retractable extension cord 82 which is stored in a coil 84 mounted at the bottom of housing 12. Handles 86 are provided at either side of housing 12 to allow for easy pulling or pushing of waste management system 12 to the desired location.

To operate waste management system 10, funnel 16 is rotated in the direction of arrow D and secured by clip 50. A bag 32 is positioned within clasps 54 and funnel 16 is returned to its resting position with its bottom 44 extending within bag 32. Waste management system 10 is turned on (after initial set-up, waste management system 10 may be continuously operated during the bag replacement procedure) through control box 28. Housing 12 is then transported to the desired waste disposal location and solid waste 34 is deposited within funnel 16 which guides the solid waste into bag 32. Any aerosol waste resulting from the dumping of solid waste 34 is carried through filter 26 by the negative pressure provided by negative pressure plenum 18. The contaminated air then becomes filtered and passes through negative plenum 18 and is forced out through second filter 30 by blower 24. The filtered air is disbursed into the room joining the other room air.

When bag 32 is full, funnel 16 is pivoted in the direction of arrow D and secured by clasp 50. Bag 32 is removed from clasps 54 and tied closed. Both bag 32 and box 36 (if present) are removed from solid waste storage area 20 through doors 38. A new bag is then inserted into clasp 54 and funnel 16 is returned to its original position. During the entire process, blower 24 remains on so that any airborne contaminants which may result from the action of tying bag 32 will not escape from waste management system 10. When filter 26 becomes clogged, the pressure within plenum 18 changes due to the decrease in air passing through negative pressure plenum 18. This change in pressure is detected by control box 28 and an indicating light 88 found on control box 28 signals the condition of filter 26. Grill 48 is then removed and a new filter 26 is inserted.

By providing a waste management disposal system having a waste management disposal area for receiving solid waste and a negative pressure plenum for drawing air through a filter across the solid waste storage area in a direction orthogonal to the solid waste storage area, a more efficient waste management disposal system is provided. By providing a tetrahedron funnel for guiding solid waste into the solid waste storage area, a baffle system is provided which decreases the amount of airborne solid waste particles which may clog the filter of the aerosol contaminant removal system. By providing clasps within the housing for the entire system at a point below the funnel, a quick release waste storage bag positioning structure is provided. Additionally, by providing wheels for the waste management system, the waste management system may be brought to each contaminated site reducing the risk of contamination inherent in transporting contaminated materials.

It will thus be seen that the objects set forth above, among those made apparent from the preceding description, are efficiently attained and, since certain changes may be made in the above construction without departing from the spirit and the scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A waste management disposal system for disposing solid and aerosol waste comprising a housing, the housing defining a solid waste containment chamber within said housing for receiving solid waste deposited within said housing; said waste containment chamber being formed with an entrance opening to allow waste to pass into said containment chamber; guide means for guiding said solid waste into said solid waste containment area; pressure inducing means positioned at or above said entrance opening without said containment chamber for causing solid waste to be deposited within said solid waste containment chamber while drawing aerosol waste away from said solid waste containment chamber in a path substantially orthogonal to said guide means; and filter means for filtering contaminants drawn from said aerosol waste by said pressure inducing means.

2. The waste management disposal system of claim 1, wherein the guide means comprises at least one truncated tetrahedron extending into said solid waste containment area.

3. The waste management disposal system of claim 2, wherein said guide means is pivotably and releasably disposed within said housing.

4. The waste management disposal system of claim 3, further comprising a back splash plate affixed to said housing, said guide means including a flange extending from a rear edge of said guide means, said back splash plate overlapping said flange.

5. The waste management disposal system of claim 3, wherein said guide means pivots from a waste guiding position to a non-waste guiding position; and further comprising clip means mounted on said housing for selectively maintaining said guide means in the non-guide position.

6. The waste management disposal system of claim 1, wherein the pressure inducing means includes a negative pressure plenum.

7. The waste management disposal system of claim 6, wherein the pressure inducing means further includes a blower disposed within the negative pressure plenum.

8. The waste management disposal system of claim 1, wherein said filter means includes three filters disposed within said housing and providing an interface with said negative pressure plenum.

9. The waste management disposal system of claim 8, wherein at least one of the filters is a HEPA filter.

10. The waste management disposal system of claim 8, wherein at least one of the filters is a pleated pre-filter.

11. The waste management disposal system of claim 8, wherein at least one of the filters is a polyester filter.

12. The waste management disposal system of claim 8, wherein the housing further comprises an exhaust for exhausting air from said pressure inducing means; said filter means further including at least one filter disposed at said exhaust.

13. The waste management disposal system of claim 1, further comprising clasping means for maintaining a waste container in position within said solid waste containment chamber.

14. The waste management disposal system of claim 13, wherein the clasping means includes a front surface, a retaining arm selectively positioned in abutting relationship with said front surface; said retaining arm being displaceable from a first position to a second position, the retaining arm being in abutting relationship with said front surface in the first position; whereby said waste container is inserted with the clasping means when said clasping means is in the second position and is retained by said clasping means when said clasping means is in the first position.

15. The waste management disposal system of claim 14, further comprising biasing means for biasing said retaining arm in the first position.

16. The waste management disposal system of claim 13, wherein the guide means comprises at least one truncated tetrahedron extending into said solid waste containment chamber.

17. The waste management disposal system of claim 13, wherein said guide means is pivotably and releasably disposed within said housing.

18. The waste management disposal system of claim 13, further comprising a back splash plate affixed to said housing, said guide means including a flange extending from a rear edge of said guide means said back splash plate overlapping said flange.

19. The waste management disposal system of claim 13, wherein said guide means pivots from a waste guiding position to a non-waste guiding position; and further comprising clip means on said housing for selectively maintaining said guide means in the non-guide position.

20. The waste management disposal system of claim 13, wherein the pressure inducing means includes a negative pressure plenum.

21. The waste management disposal system of claim 20, wherein the pressure inducing means further includes a blower disposed within the negative pressure plenum.

22. The waste management disposal system of claim 20, wherein said filter means includes three filters disposed within said housing and providing an interface with said negative pressure plenum.

23. The waste management disposal system of claim 13, wherein at least one of the filters is a HEPA filter.

24. The waste management disposal system of claim 23, wherein at least one of the filters is a pleated pre-filter.

25. The waste management disposal system of claim 23, wherein at least one of the filters is a polyester filter.

26. The waste management disposal system of claim 23, wherein the housing further comprises an exhaust for exhausting air from said pressure inducing means; said filter means further including a filter disposed at said exhaust.

27. The waste management disposal system of claim 1, further comprising wheels; said housing being mounted on said wheels.

* * * * *